US008952280B2

(12) United States Patent
Mori et al.

(10) Patent No.: US 8,952,280 B2
(45) Date of Patent: Feb. 10, 2015

(54) SWITCH CASE HAVING FLANGES THAT FOLD OVER CLEARANCE BETWEEN CASE AND COVER

(71) Applicants: Koji Mori, Aichi (JP); Yuichi Fujii, Aichi (JP)

(72) Inventors: Koji Mori, Aichi (JP); Yuichi Fujii, Aichi (JP)

(73) Assignee: Omron Automotive Electronics Co., Ltd., Aichi (JP)

( * ) Notice: Subject to any disclaimer, the term of this patent is extended or adjusted under 35 U.S.C. 154(b) by 93 days.

(21) Appl. No.: 13/780,476

(22) Filed: Feb. 28, 2013

(65) Prior Publication Data

US 2013/0220785 A1 Aug. 29, 2013

(30) Foreign Application Priority Data

Feb. 28, 2012 (JP) ..... 2012-041587

(51) Int. Cl.
*H01H 9/04* (2006.01)
*H01H 21/08* (2006.01)
*H01H 21/22* (2006.01)

(52) U.S. Cl.
CPC ..... *H01H 9/04* (2013.01); *H01H 21/08* (2013.01); *H01H 2021/225* (2013.01); *H01H 2223/002* (2013.01); *H01H 2300/01* (2013.01)
USPC ..... 200/302.1

(58) Field of Classification Search
USPC ..... 200/302.1, 302.2, 302.3, 293; 439/521, 439/76.1, 76.2; 312/229; 52/11
See application file for complete search history.

(56) References Cited

U.S. PATENT DOCUMENTS

| | | | | |
|---|---|---|---|---|
| 4,275,279 | A * | 6/1981 | Wagatsuma et al. | 200/11 DA |
| 4,766,277 | A * | 8/1988 | Bigelow, Jr. | 200/293 |
| 4,972,057 | A * | 11/1990 | Miyata | 200/293 |
| 5,055,642 | A * | 10/1991 | Miyata | 200/293 |
| 5,824,981 | A | 10/1998 | Suzuki | |
| 5,876,243 | A | 3/1999 | Sangawa | |
| 7,358,438 | B2 * | 4/2008 | Zoller | 174/50 |
| 7,550,690 | B2 | 6/2009 | Shimizu et al. | |
| 8,188,395 | B2 * | 5/2012 | Steidle et al. | 200/302.1 |
| 8,222,549 | B2 * | 7/2012 | Burca et al. | 200/293 |
| 2006/0087500 | A1 | 4/2006 | Shimizu et al. | |

FOREIGN PATENT DOCUMENTS

| | | |
|---|---|---|
| CN | 1763876 A | 4/2006 |
| JP | H05-205561 A | 8/1993 |

(Continued)

OTHER PUBLICATIONS

Japanese Office Action for Application No. 2012-041587, mailed on Jul. 8, 2014 (5 pages).

(Continued)

*Primary Examiner* — Vanessa Girardi
(74) *Attorney, Agent, or Firm* — Osha Liang LLP

(57) ABSTRACT

A switch device has an operating unit, a circuit board having a contact unit that is switched according to the operation of the operating unit, a case having the operating unit at an upper section thereof, an opening at a lower section thereof, and the circuit board inside thereof, and a cover that is fitted to the opening of the case to close the opening. A thin hinge and a flange continuous to the hinge are formed integrally with the case along a side wall at a lower end of the side wall of the case. The flange is folded and bent on the hinge, so that a clearance defined between the case and the cover is covered with the flange.

9 Claims, 11 Drawing Sheets

(56) References Cited

FOREIGN PATENT DOCUMENTS

| | | | |
|---|---|---|---|
| JP | 9204842 | A | 8/1997 |
| JP | 9265851 | A | 10/1997 |
| JP | H11-308734 | A | 11/1999 |
| JP | 2000-322979 | A | 11/2000 |
| JP | 2006120468 | A | 5/2006 |
| JP | 2011-044261 | A | 3/2011 |

OTHER PUBLICATIONS

English translation of Office Action issued in Chinese Application No. 201310064047.X, mailed on Oct. 22, 2014 (7 pages).

* cited by examiner

SWITCH CASE HAVING FLANGES THAT FOLD OVER CLEARANCE BETWEEN CASE AND COVER

BACKGROUND OF THE INVENTION

1. Technical Field

The present invention relates to a waterproof switch device provided with a structure capable of preventing any intrusion of water.

2. Related Art

An automobile is provided with a power window switch for controlling the opening/closing of a window. In general, a power window switch includes: an oscillatable operating knob that is manually operated; a circuit board having a contact unit for outputting a signal in response to the operation of the operating knob; a case containing the circuit board therein; and a cover that is fitted to an opening formed at the lower portion of the case so as to cover the opening.

In the above power window switch, a raindrop intruding through an open window or a spilt beverage (hereinafter generically referred to as "water") may intrude into the case. And then, the water intruding into the case adheres to the circuit board, thereby inducing short-circuiting of an electric circuit or corrosion of the contact unit so as to cause an erroneous operation of the switch. Japanese Unexamined Patent Publication Nos. 9-265851, 2006-120468, and 9-204842 disclose a structure for preventing such intrusion of water.

Japanese Unexamined Patent Publication No. 9-265851 discloses a power window switch provided with a structure for allowing a projection formed at the side surface of a lower case (i.e., a cover) to be fitted to a hole formed at the side surface of an upper case, the switch including a rib surrounding the hole formed at the side surface of the upper case, wherein the rib guides downward water flowing down from the upper surface of the upper case along the side surface thereof and drains it. However, this structure has a fear of the water intrusion into the hole because of a capillary phenomenon since the water flows over the rib to the vicinity of the hole in the case of the large amount of water flowing down from the upper surface of the upper case.

As a countermeasure against this, Japanese Unexamined Patent Publication No. 2006-120468 discloses that a groove spaced from a side surface of an upper case is formed around a projection formed at the side surface of a lower case (i.e., a cover), so that a predetermined interval is secured between the periphery of the projection formed at the lower case and the hole formed at the upper case. In this manner, even if water flows in the vicinity of the hole formed at the upper case, the interval can inhibit any intrusion of water into a container because of a capillary phenomenon.

Japanese Unexamined Patent Publication No. 9-204842 discloses a power window switch including eaves covering the upper portion of a connector provided at the side of a case, an upper water stopping wall erected at the front edge of the eaves, and a side water stopping wall covering both sides of the connector. In this switch, the eaves receive the water flowing from the upper portion of the case, and then, the upper water stopping wall guides the water toward the side water stopping wall so as to make the water flow along the side water stopping wall, thus preventing the intrusion of the water toward the connector.

As described above, there have been conventionally proposed the various kinds of techniques for preventing any intrusion of water flowing downward from a side surface of a case into the inside thereof. However, the water intruding into the case intrudes into the case not only from the side surface of the case but also from the back of the case. Although the back of the case is closed with a cover, the water intrudes into the inside through a minute clearance defined between the case and the cover because of a capillary phenomenon.

SUMMARY

One or more embodiments of the present invention provides a switch device capable of preventing any intrusion of water from the back of a case into the inside thereof.

In accordance with one or more embodiments of the present invention, a switch device includes: an operating unit; a circuit board having a contact unit that is switched according to the operation of the operating unit; a case having the operating unit at an upper section thereof, an opening at a lower section thereof, and the circuit board inside thereof; and a cover that is fitted to the opening of the case, thus closing the opening; wherein a thin hinge and a flange continuous to the hinge are formed integrally with the case along a side wall at a lower end of the side wall of the case, and the flange is folded and bent on the hinge, so that a clearance defined between the case and the cover is covered with the flange.

With this configuration, the clearances defined between the case and the cover are covered with the flanges. Therefore, the flanges can inhibit the water going around the back of the case from intruding into the inside of the case through the clearances due to a capillary phenomenon. Moreover, the flanges are formed integrally with the case together with the hinges. Thus, simple folding/bending facilitates assembling work and reduces the number of constituent elements in comparison with the case where the clearances defined between the case and the cover are sealed with other members.

According to one or more embodiments of the present invention, the flanges may be formed at the lower ends of the four side walls of the case, respectively, and ends of the flanges may be superimposed on the ends of the flanges of the adjacent side walls in a state in which the flanges are folded and bent. In this manner, the ends of the flanges are superimposed one on another, and therefore, water hardly intrudes at the ends, thus enhancing waterproofness.

In this case, according to one or more embodiments of the present invention, a thin portion should be formed at a portion at which the ends of the flanges are superimposed one on another. In this manner, the superimposed portions at the ends do not become thick, thus suppressing an increase in height of the switch device.

According to one or more embodiments of the present invention, the hinge may project sideways from the side wall of the case in the state in which the flange is folded and bent. Consequently, the hinges projecting from the side walls function as eaves, and therefore, it is possible to more effectively prevent the water flowing down along the side walls of the case from going around the back of the case.

In this case, according to one or more embodiments of the present invention, a recess should be formed at a portion at which the ends of the flanges are superimposed one on another. In this manner, the superimposed portions at the ends do not become thick, thus suppressing an increase in height of the switch device.

According to one or more embodiments of the present invention, a hook having elasticity may be formed at the cover, and further, the folded and bent flange is securely hooked on the hook. Consequently, the flanges can be readily secured by simply folding and bending the flanges and then hooking them on the hooks, thus enhancing the efficiency of assembling work.

One or more embodiments of the present invention can provide the switch device capable of preventing water from intruding from the back of the case to the inside thereof.

DETAILED DESCRIPTION

Figure 1:
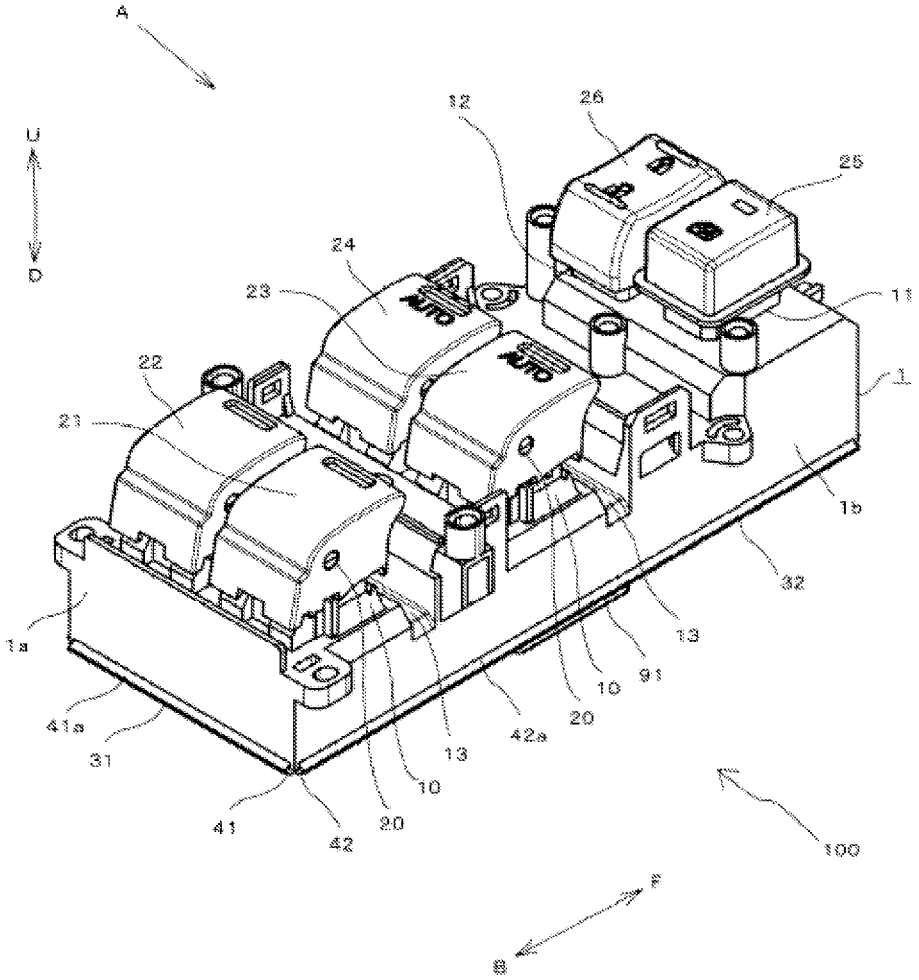
FIG. 1 is a perspective view showing a switch device according to one or more embodiments of the present invention.

Embodiments of the present invention will be described below with reference to the attached drawings. In each of the drawings, the same or corresponding constituent elements are designated by the same reference numerals. Moreover, an arrow "U" denotes upward; "D", downward; "F", forward; and "B", rearward. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

A switch device 100 shown in the drawings is a power window switch for a vehicle, which is fixed to, for example, an arm rest (not shown) disposed inside of a door on a driver's seat. As shown in FIG. 1, the switch device 100 is provided with a case 1 and a plurality of operating knobs 21 to 26 disposed at the upper portion of the case 1. The operating knobs 21 to 26 exemplify an "operating unit" according to one or more embodiments of the present invention.

Figure 2:
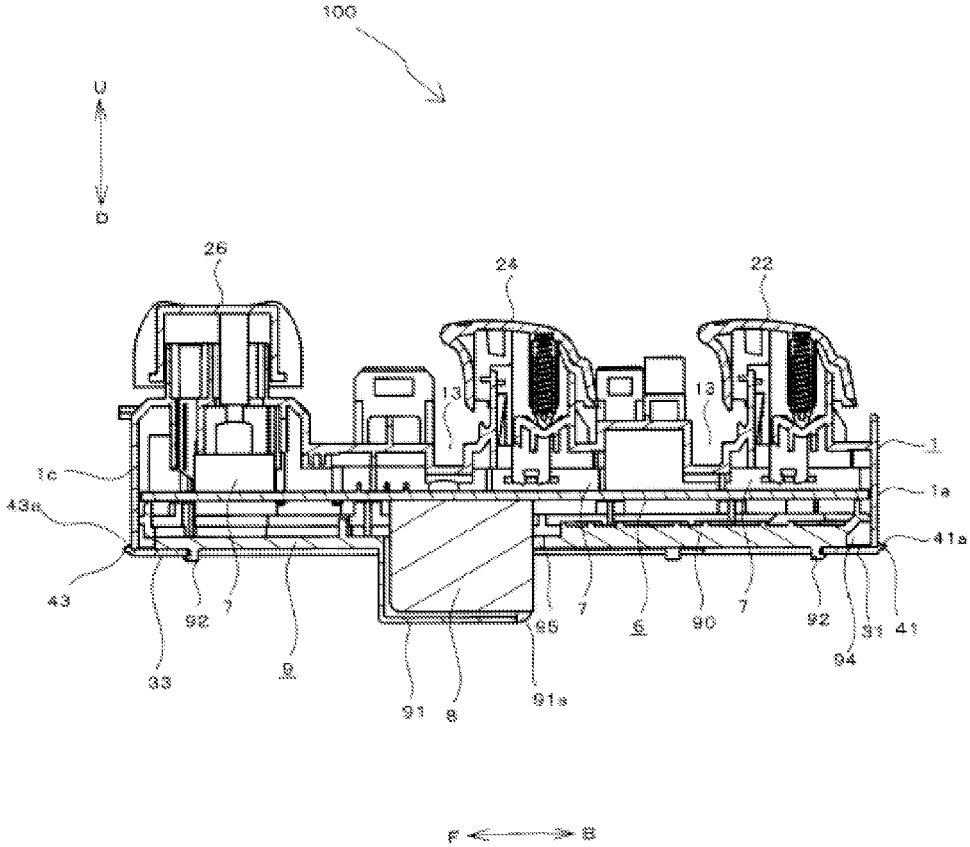
FIG. 2 is a cross-sectional view showing the switch device shown in FIG. 1, as viewed in a direction indicated by an arrow A.
Figure 4:
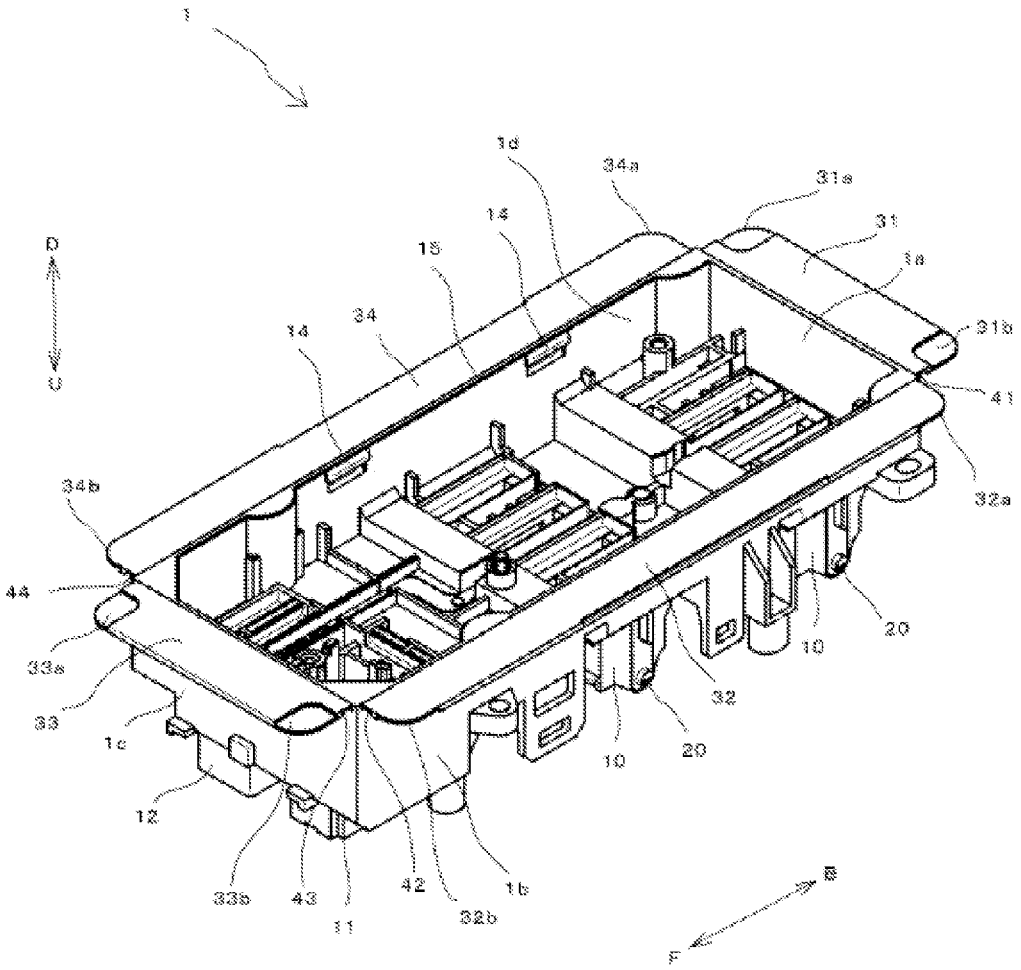
FIG. 4 is a perspective view showing the switch device, as viewed backward in FIG. 3.
Figure 7:
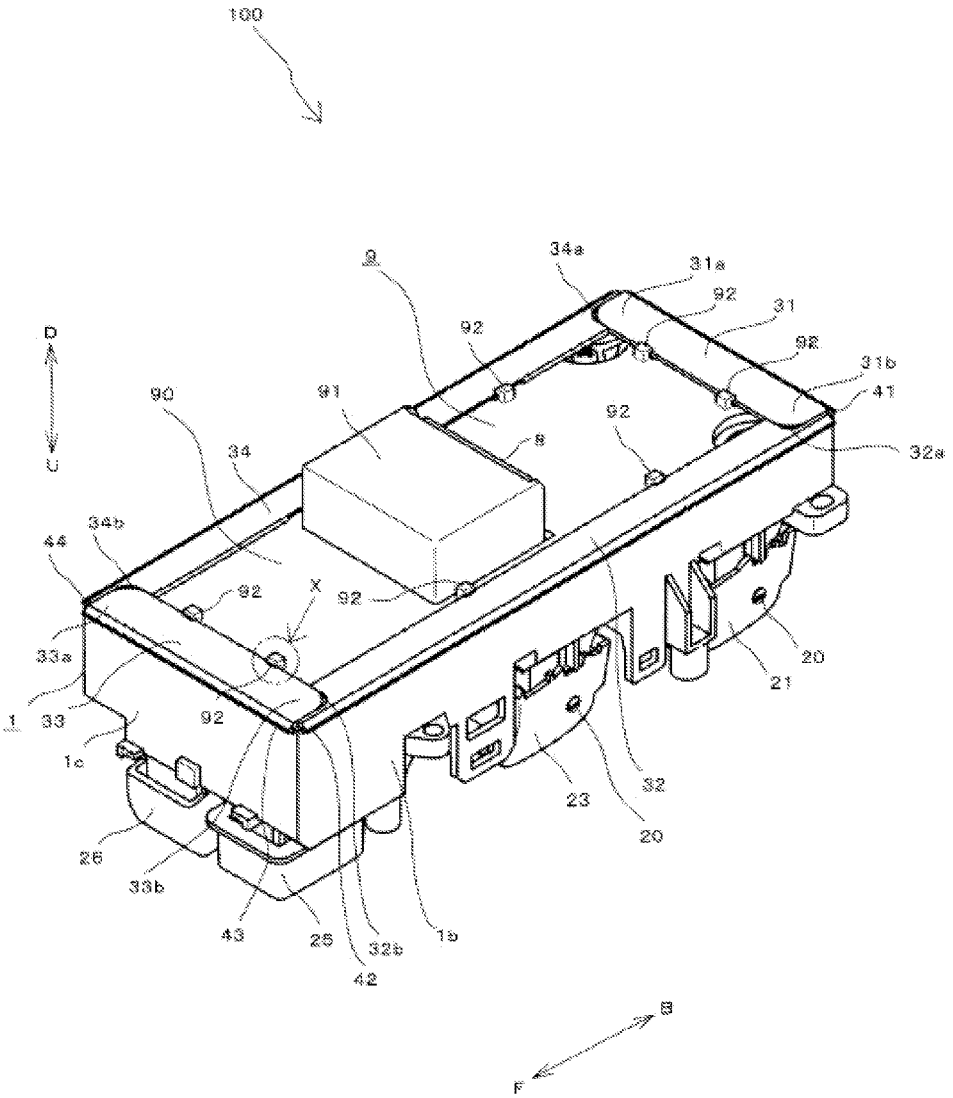
FIG. 7 is a view showing the state in which flanges are folded in FIG. 6.

The case 1 is formed into a box shape, and has four side walls 1*a* to 1*d* (see FIG. 4). The lower side of the case 1 is opened. A cover 9 is fitted to an opening 15, as shown in FIGS. 2 and 7. The opening 15 of the case 1 is covered with the cover 9.

The operating knobs 21 to 24 are pivotally supported in cylindrical portions 10 disposed at the upper surface of the case 1 on shafts 20, respectively. These operating knobs are operated to open or close windows at the driver's seat, a passenger's seat, a left rear passenger's seat, and a right rear passenger's seat, respectively.

The operating knob 25 is a push type knob that is supported in a cylindrical portion 11 disposed at the upper surface of the case 1 in a vertically movable manner. The operating knob 25 is operated to prohibit the windows at the passenger's seat and the rear passenger's seats from being opened or closed or to release the prohibition.

The operating knob 26 is a seesaw type knob that is pivotally supported in a cylindrical portion 12 disposed at the upper surface of the case 1 on a shaft, not shown. The operating knob 26 is operated to lock or unlock doors for each of the seats.

The structure and operation of each of the operating knobs 21 to 26 are the same as those in the conventional art, and further, they are not directly relevant to embodiments of the present invention. Therefore, their detailed descriptions will not be given here.

As shown in FIG. 1, two grooves 13 are formed in the vicinity of the cylindrical portions 10 at the upper surface of the case 1. These grooves 13 are gutters for draining water dropping on the case 1 from above. Therefore, one end of the groove 13 is released sideways.

As shown in FIG. 2, a circuit board 6 is housed inside of the case 1. Contact units 7 that can be switched according to the operations of the operating knobs 21 to 26 are mounted on the upper surface of the circuit board 6. Here, although each of the contact units 7 is constituted of a slide switch or the like containing a contact inside of a container, the contact units may be formed directly on the circuit board 6. A connector 8 is mounted on the lower surface of the circuit board 6. The connector 8 contains a connecting terminal, not shown, therein.

Figure 5:
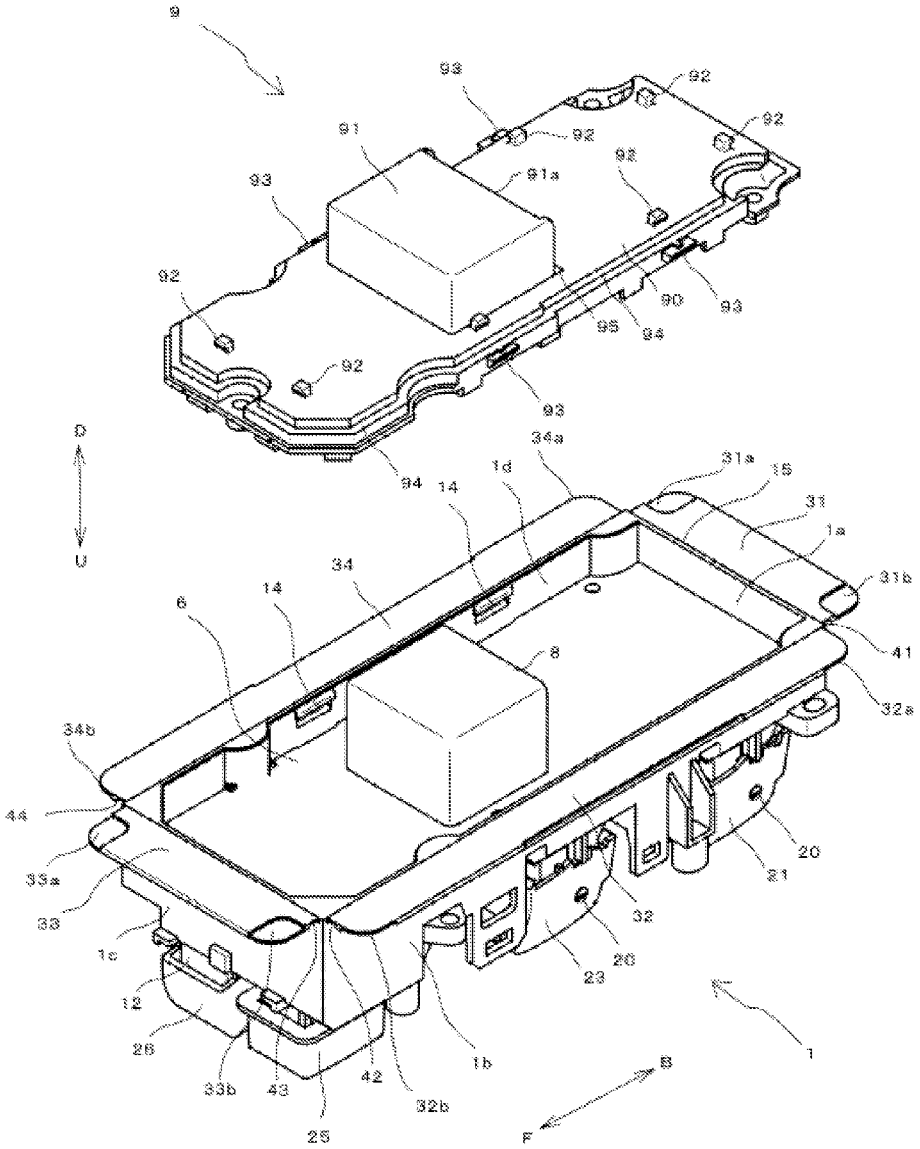
FIG. 5 is an exploded perspective view showing a case containing a circuit board therein and a cover.

As shown in FIG. 5, the cover 9 is provided with a plate-like base 90 and a connector cover 91 formed integrally with the base 90. A plurality of hooks 92 are formed integrally with the back surface of the base 90. A plurality of projections 93 are formed integrally with the side surface of the base 90. Moreover, the base 90 has cutouts 94 along the circumferential edge thereof, and further, a through hole 95, through which the connector 8 is inserted, at a position of the connector cover 91. When the cover 9 is fitted to the case 1, the cutouts 94 are provided for alleviating a capillary phenomenon produced at a clearance defined between the cover 9 and the case 1.

Figure 6:
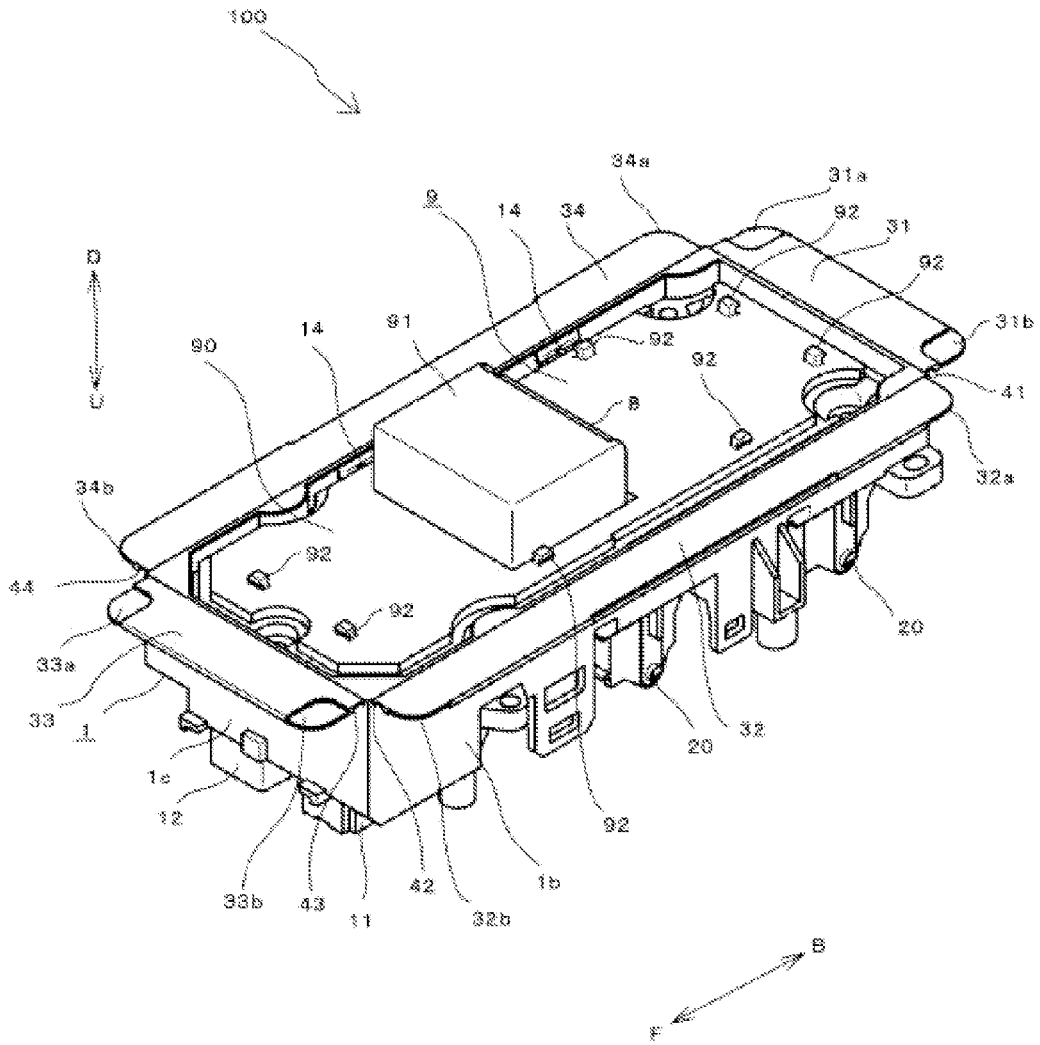
FIG. 6 is a perspective view showing the state in which the cover is attached to the case, as viewed backward.

As shown in FIGS. 4 and 5, a plurality of fitted portions 14 are formed inside of the side wall 1*d* of the case 1. Furthermore, a plurality of fitted portions similar to the fitted portions 14 are formed inside of the side wall 1*b* of the case 1, although not shown. The cover 9 is fitted to the opening 15 of the case 1, so that the projections 93 of the cover 9 are fitted to the fitted portions 14 of the case 1. In this manner, the cover 9 is fixed to the case 1, as shown in FIG. 6. At this time, the connector 8 is inserted through the through hole 95 of the cover 9, to be thus contained inside of the connector cover 91, as shown in FIG. 2.

To the connector 8 is connected another connector (not shown) provided with a cable for transmitting a signal from the switch device 100 to a controller (not shown). As a consequence, signals output from the contact units 7 according to the operations of the operating knobs 21 to 26 are transmitted to the controller via the cable, and then, the controller controls the opening or closing of the windows.

Figure 3:
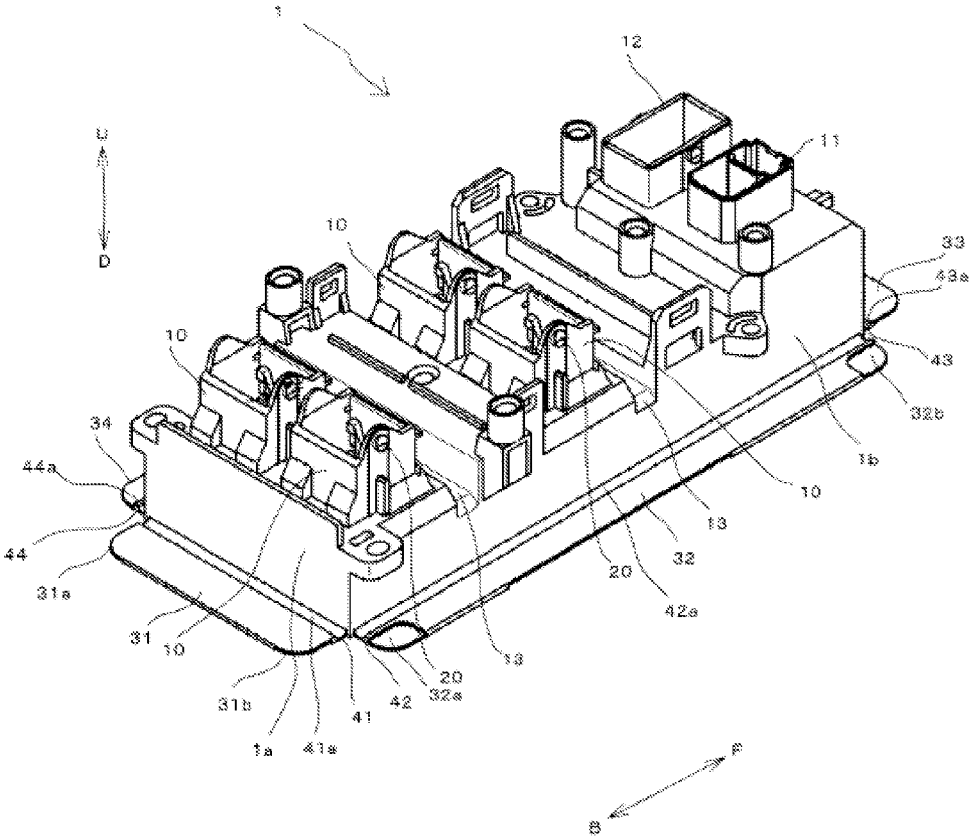
FIG. 3 is a perspective view showing the switch device shown in FIG. 1 in the state in which operating knobs are detached.

As shown in FIGS. 3 and 4, thin hinges 41 to 44 and flanges 31 to 34 continuous to the hinges are formed integrally with the case 1 along the side walls 1*a* to 1*d* at the lower ends of the side walls 1*a* to 1*d* of the case 1. The hinges 41 to 44 and the flanges 31 to 34 are molded with resins together with the case 1.

Figure 10:
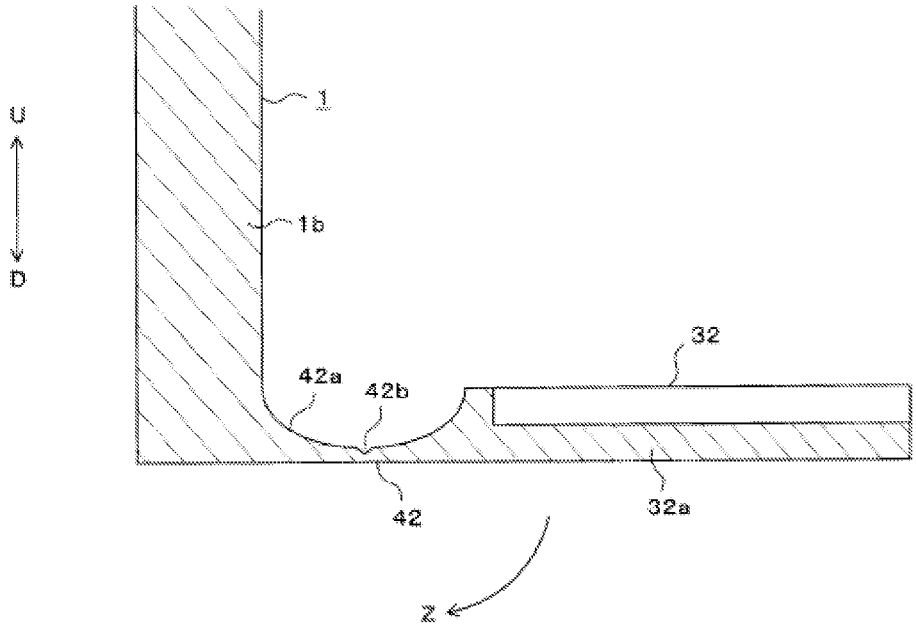
FIG. 10 is an enlarged cross-sectional view showing a hinge.

FIG. 10 is an enlarged cross-sectional view showing the end of the flange 32 shown in FIG. 3, as viewed in the direction B. The hinge 42 is formed continuously to the side wall 1*b* at the lower end of the side wall 1*b* of the case 1, and further, the flange 32 is formed continuously to the hinge 42. Since the case 1 is made of a resin material, the thin hinge 42 has elasticity. An arcuate slope 42*a* and a cutout 42*b* are formed at the upper surface of the hinge 42. As for the other hinges 41, 43, and 44, arcuate slopes 41*a*, 43*a*, and 44*a* and cutouts (not shown) are formed in the same manner, as shown in FIG. 3.

As shown in FIG. 3, the flange 32 extends along substantially the entire length of the side wall lb in the direction F-B together with the hinge 42. A recess 32*a* is formed at the end of the flange 32 in the direction B whereas another recess 32*b* is formed at the end of the flange 32 in the direction F. The other flanges 31, 33, and 34 also extend along substantially the entire length of the side walls l*a*, l*c*, and l*d* together with the hinges 41, 43, and 44, respectively (see FIG. 4).

Figure 11:
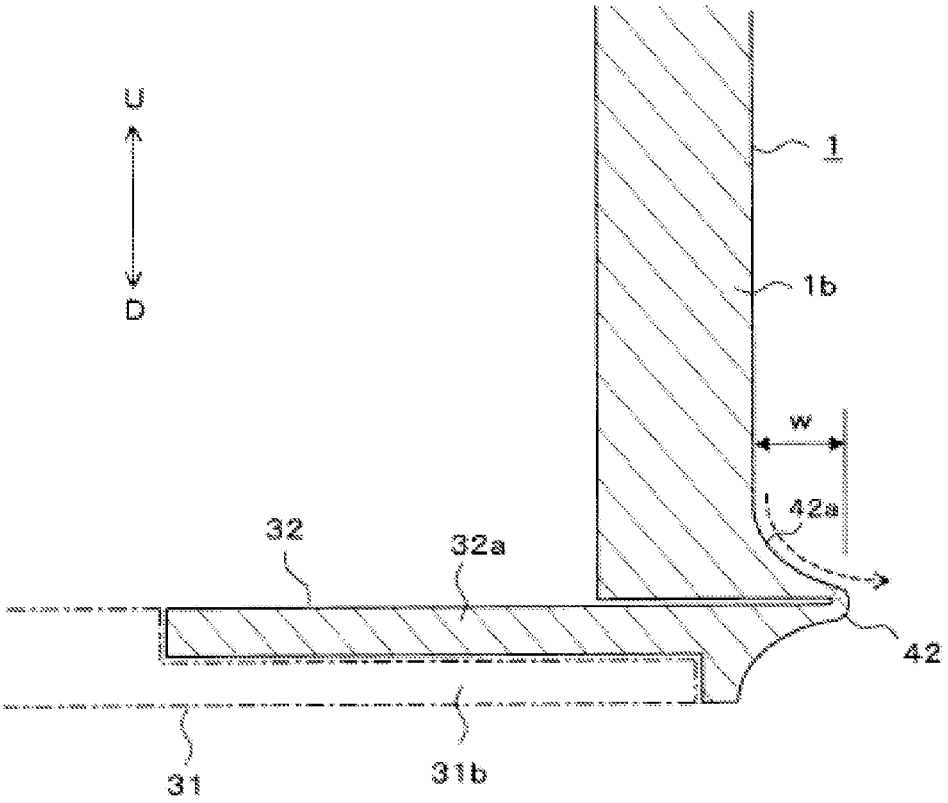
FIG. 11 is an enlarged cross-sectional view showing the state in which the flange is folded and bent.

In FIG. 10, when the flange 32 is folded and bent at 180° on the cutout 42*b* of the hinge 42 in a direction indicated by an arrow Z, the status thereof is turned to that shown in FIG. 11. In this state, the hinge 42 projects by a width w sideways of the side wall l*b* of the case 1. Here, the upper surface of the projecting hinge 42 serves as the slope 42*a*. The recess 32*a* of the flange 32 is superimposed on the recess 31*b* of the flange 31 of the adjacent side wall 1*a* (FIG. 3) (described in detail later).

As shown in FIG. 7, the other flanges 31, 33, and 34 are folded and bent at 180° on the hinges 41, 43, and 44, respectively, in the same manner. The flanges 31 to 34 that are folded and bent are securely hooked on the hooks 92 formed at the cover 9. The hooks 92 are formed integrally with the base 90 made of resin, and therefore, they have elasticity.

Figure 8:
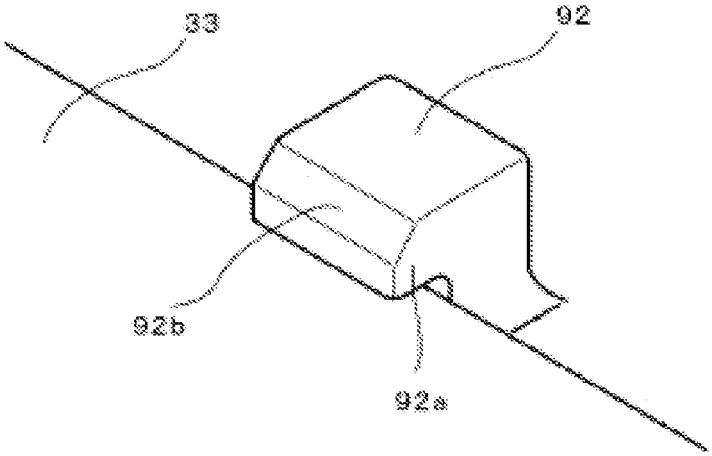
FIG. 8 is an enlarged perspective view showing a section X in FIG. 7.
Figure 9:
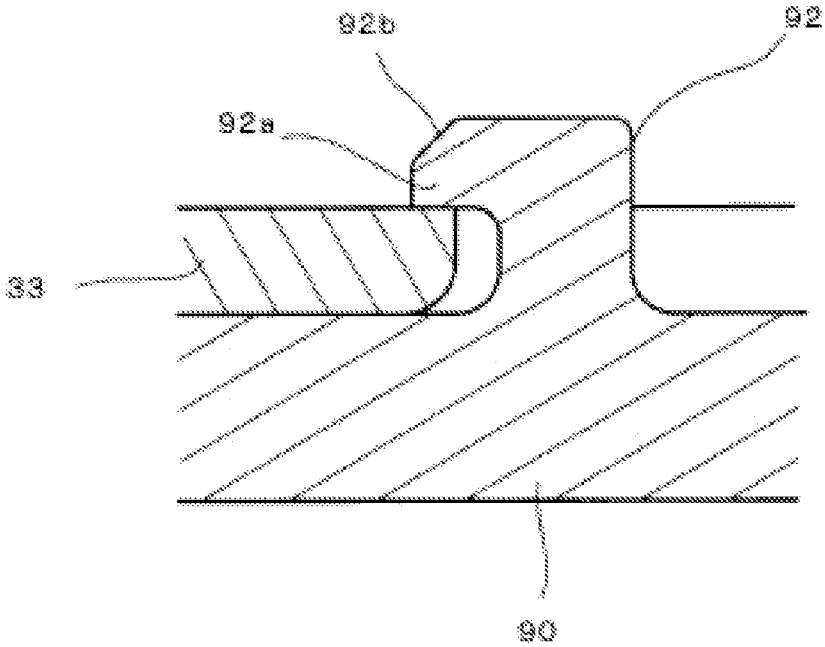
FIG. 9 is an enlarged cross-sectional view showing the section X in FIG. 7.

FIG. 8 is an enlarged view showing a section X in FIG. 7, The hook 92 has a claw 92*a* which has a slope 92*b* formed thereon. When the flange 33 folded and bent on the hinge 43 is pushed along the slope 92*b* from above the hook 92, the edge of the flange 33 is hooked on the claw 92*a*, and thus, the flange 33 is fixed to the base 90, as shown in FIG. 9.

In the state in FIG. 7, the cutouts 94 formed at the cover 9 shown in FIG. 5 are covered with the flanges 31 to 34. Furthermore, clearances defined between the outer peripheral surface of the cover 9 and the inner circumferential surface of the case 1, the clearances being produced when the cover 9 is fitted to the case 1, are covered with the flanges 31 to 34. Moreover, the recesses 31*a* and 31*b* formed at both ends of the flange 31 are superimposed on the respective recesses 34*a* and 32*a* formed at the ends of the flanges 34 and 32. Additionally, the recesses 33*a* and 33*b* formed at both ends of the flange 33 are superimposed on the respective recesses 34*b* and 32*b* formed at the other ends of the flanges 34 and 32. In other words, in the state in which each of the flanges is folded and bent, the end of each of the flanges is superimposed on the end of the flange of the adjacent side wall.

The switch device 100 having the above configuration is assembled, as follows: the circuit board 6 is securely inserted into the opening 15 of the case 1; the opening 15 is closed with the cover 9; and the flanges 31 to 34 are folded and bent at the hinges 41 to 44 to be then hooked on the hooks 92 of the cover 9 (see FIGS. 5 to 7).

In one or more of the above embodiments, the clearances defined between the case 1 and the cover 9 are covered with the flanges 31 to 34 (see FIG. 7), and therefore, the flanges 31 to 34 can prevent the water going around the back of the case 1 from intruding into the inside of the case 1 through the clearances due to the capillary phenomenon. Moreover, the flanges 31 to 34 are formed integrally with the case 1 together with the hinges 41 to 44, and therefore, they can be simply folded and bent. Thus, there is an advantage that assembling work becomes simpler with the smaller number of constituent elements in comparison with the case where the clearances defined between the case 1 and the cover 9 are sealed with other members.

Moreover, in one or more of the above embodiments, the ends of the folded and bent flanges 31 to 34 are superimposed on the ends of the flanges of the adjacent side walls, and therefore, the water hardly intrudes at the ends of the flanges 31 to 34, thus enhancing the waterproofness.

Additionally, in one or more of the above embodiments, the recesses 31*a* to 34*a* and 31*b* to 34*b* are formed at the ends of the flanges 31 to 34 superimposed one on another, so that the superimposed ends do not become thick, thus suppressing the height of the switch device 100. Here, since the flanges 31 to 34 are the same in thickness as each other, the thickness of each of the recesses 31*a* to 34*a* and 31*b* to 34*b* is set to a half of the portions other than the recesses, so that the flanges 31 to 34 can become flush with each other.

In addition, in one or more of the above embodiments, the hinges 41 to 44 project sideways of the side walls 1*a* to 1*d* of the case 1 in the state in which the flanges 31 to 34 are folded and bent (see FIGS. 1 and 11). In this manner, the hinges 41 to 44 projecting from the side walls 1*a* to 1*d*, respectively, function as eaves, and therefore, the water flowing down along the side walls 1*a* to 1*d* can be prevented from going around the back of the case 1. In particular, in one or more of the above embodiments, the draining grooves 13 are provided for allowing the water drained through the grooves 13 to flow down along the side walls 1*a* to 1*d*. Here, the water can be inhibited from going around the back of the case 1 owing to the hinges 41 to 44.

Furthermore, in one or more of the above embodiments, the upper surfaces of the hinges 41 to 44 projecting from the side walls 1*a* to 1*d* of the case 1 function as the slopes 41*a* to 44*a*. As a consequence, as indicated by a broken-line arrow in FIG. 11, the water flowing down along the side wall 1*b* can be readily drained sideways. The same goes for the water flowing down along the other side walls. Thus, it is possible to more effectively prevent the water from going around the back of the case 1.

Moreover, in one or more of the above embodiments, the cover 9 has the plurality of elastic hooks 92, on which the flanges 31 to 34 are securely hooked. Therefore, the flanges 31 to 34 are folded and bent on the hinges 41 to 44, to be then hooked on the hooks 92, so that the flanges 31 to 34 can be readily fixed. Thus, the efficiency of the assembling work can be enhanced.

Various embodiments other than the above-described embodiments are with a scope of the invention. Although the flanges 31 to 34 are disposed on substantially the entire circumference of the opening 15 of the case 1 in one or more of the above embodiments, as shown in FIG. 4, flanges may be formed only at portions which need water shielding. Moreover, although the hinges 41 to 44 are continuously formed along substantially the entire length of the side walls 1*a* to 1*d* in one or more of the above embodiments, the hinges may be intermittently disposed at intervals.

Figure 12:
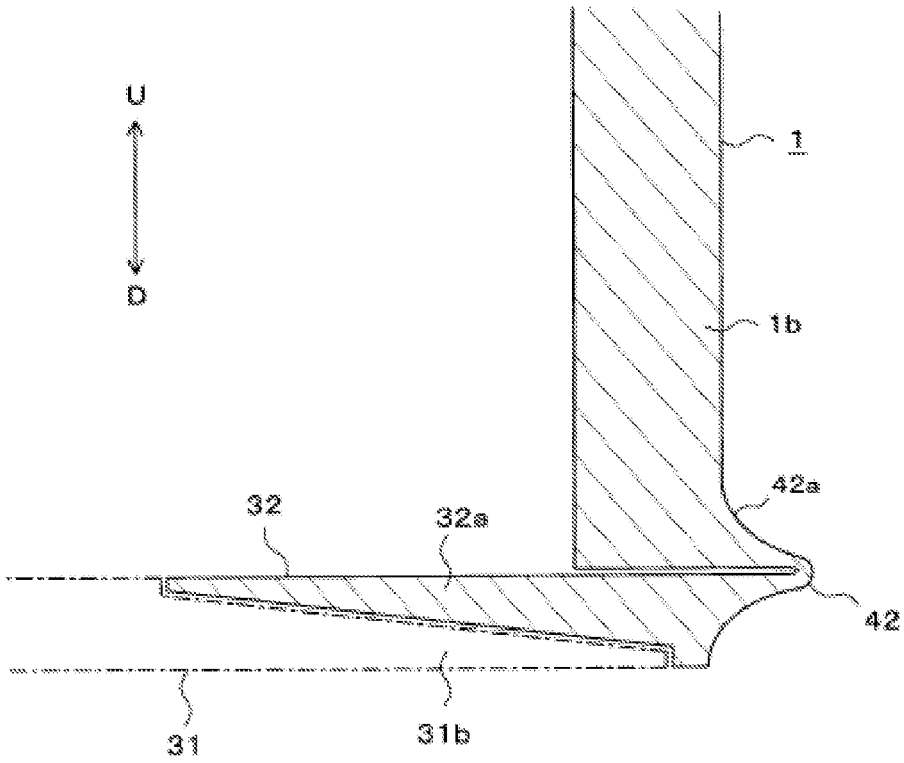
FIG. 12 is an enlarged cross-sectional view showing the hinge according to one or more embodiments of the present invention.

Furthermore, although the flanges 31 to 34 are superimposed at their ends one on another in one or more of the above embodiments, as shown in FIG. 7, a structure in which the ends of the flanges 31 to 34 are not superimposed one on another may be adopted. Moreover, the structure is not limited to a structure in which the thickness of the respective recesses 31*b* and 32*a* of the flanges 31 and 32 is uniform, as shown in FIG. 11. As shown in FIG. 12, a structure in which the recesses 31*b* and 32*a* are tapered may be adopted (the same goes for the other recesses).

In one or more of the above embodiments, as shown in FIG. 5, the projections 93 formed at the side surfaces of the base 90 of the cover 9 are fitted to the fitted portions 14 formed inside of the side walls 1*b* and 1 d of the case 1 so that the cover 9 is secured to the case 1. Instead, the projections 93 formed at the side surfaces of the base 90 of the cover 9 may be fitted to the holes (not shown) formed on the side walls of the case 1, so that the cover 9 may be secured to the case 1, in the same manner as the conventional art. In this case, the countermeasures disclosed in, for example, Japanese Unexamined Patent Publication Nos. 9-265851 and 2006-120468 may be taken as countermeasures against the intrusion of the water through the holes.

One or more of the above embodiments exemplifies the switch device in which the folded and bent flanges 31 to 34, as shown in FIG. 7, are securely hooked on the hooks 92 formed at the cover 9 (i.e., the base 90). Instead, pins (not shown) are disposed in the cover 9, and further, holes, not shown, are formed in the flanges 31 to 34 that are folded and bent. At this time, the pins of the cover 9 are press-fitted into the holes formed in the flanges 31 to 34, so that the flanges 31 to 34 may be fixed to the cover 9. Alternatively, the flanges 31 to 34 may be fixed to the cover 9 by bonding or thermal welding.

In addition, one or more of the above embodiments exemplifies the switch device 100 provided with the six operating knobs 21 to 26, as shown in FIG. 1. However, the number of operating knobs may not be six. Furthermore, the structure of the operating knob is not limited to the example illustrated. For example, one or more embodiments of the present invention is applicable to a switch device provided with rotary operating knobs.

Additionally, although the switch device 100 exemplifies the power window switch for a vehicle in one or more of the above embodiments, one or more embodiments of the present invention is applicable to a switch device for usages other than a vehicle.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A switch device comprising:

an operating unit;

a circuit board having a contact unit that is switched according to operation of the operating unit;

a case having a plurality of side walls which form an opening within which the operating unit is arranged at an upper section thereof, and the circuit board is arranged at a lower section thereof; and a cover that is fitted to the opening of the case to close the opening, such that a flange integrally formed with the case through a continuous hinge along a lower end of each side wall of the case, enables each flange to be folded and bent along the respective hinge, such that a clearance defined between the case and the cover is covered with the flange.

2. The switch device according to claim 1, wherein a hook having elasticity is formed on the cover, such that the folded and bent flanges are securely hooked on the hook.

3. The switch device according to claim 1, wherein an upper surface of each hinge projecting from the side wall has a slope.

4. The switch device according to claim 3, wherein a hook having elasticity is formed on the cover, and further, the folded and bent flange is securely hooked on the hook.

5. The switch device according to claim 1, wherein wherein ends of the flanges are superimposed on the ends of adjacent flanges in a state in which the flanges are folded and bent.

6. The switch device according to claim 5, wherein a hook having elasticity is formed on the cover, and further, the folded and bent flange is securely hooked on the hook.

7. The switch device according to claim 5, wherein a recess is formed at a point where ends of the flanges are superimposed one on another.

8. The switch device according to claim 7, wherein a hook having elasticity is formed on the cover, and further, the folded and bent flange is securely hooked on the hook.

9. The switch device according to claim 7, wherein a hook having elasticity is formed on the cover, and further, the folded and bent flange is securely hooked on the hook.

* * * * *